US006965070B2

(12) United States Patent
Wenjun

(10) Patent No.: US 6,965,070 B2
(45) Date of Patent: Nov. 15, 2005

(54) UPRIGHT KEYBOARD INSTRUMENT

(75) Inventor: Pu Wenjun, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 308 days.

(21) Appl. No.: 10/392,555

(22) Filed: Mar. 20, 2003

(65) Prior Publication Data

US 2003/0177885 A1 Sep. 25, 2003

(30) Foreign Application Priority Data

Mar. 25, 2002 (JP) ..... 2002-084171

(51) Int. Cl.[7] ..... G10H 1/32

(52) U.S. Cl. ..... 84/719; 84/721; 84/744; 84/746; 84/DIG. 7

(58) Field of Search ..... 84/600, 615, 626, 84/658, 687–690, 719–721, 744–746, 2–3, 84/20–23, 171–174, DIG. 7, DIG. 25

(56) References Cited

U.S. PATENT DOCUMENTS 2,308,051 A * 1/1943 Cahill ..... 84/680
3,927,594 A * 12/1975 Morita ..... 84/237
5,272,950 A * 12/1993 Petersen ..... 84/236
5,287,787 A 2/1994 Satoshi
5,880,389 A * 3/1999 Muramatsu ..... 84/615
5,936,172 A * 8/1999 de La Rochefordiere ..... 84/217
5,986,202 A 11/1999 Seiler
6,054,641 A 4/2000 Inoue
6,248,943 B1 6/2001 Inoue

FOREIGN PATENT DOCUMENTS

DE 196 44 780 A1 4/1997
DE 197 16 177 A1 10/1998
DE 199 42 441 A1 5/2000

* cited by examiner

*Primary Examiner*—Marlon Fletcher
(74) *Attorney, Agent, or Firm*—Harness, Dickey & Pierce, P.L.C.

(57) ABSTRACT

An upright keyboard instrument comprises a prescribed number of keys that are interlocked with actions, hammer assemblies, and a plate spring unit, which is interlocked with a loud pedal. When the key is depressed, the action is activated to drive the hammer assembly, thus producing a musical tone. Each of plate springs is normally arranged close to an end portion of a whippen included in the action. Upon depression of the key, the end portion of the whippen comes in contact with the plate spring to cause a resistive force, which is transmitted back to a player's finger depressing the key. When the loud pedal is depressed, the plate spring departs from the end portion of the whippen, which becomes free to rotate upon depression of the key, thus realizing loudness effect on sound.

10 Claims, 10 Drawing Sheets

UPRIGHT KEYBOARD INSTRUMENT

BACKGROUND OF THE INVENTION

1. Field of the Invention

This invention relates to upright keyboard instruments such as electronic upright pianos that realize real key-touch feelings (or key-touch sensations) in depressing and releasing keys.

2. Description of the Related Art

In general, electronic upright pianos comprise hammers that are rotatably moved to strike strings upon depressions of keys, and actions (or action mechanisms) for transmitting movements of depressed keys to hammers, wherein movements of keys are detected by sensors to produce detection results, based on which musical tones are correspondingly produced. Therefore, players (or users) are able to play electronic upright pianos with key-touch feelings (e.g., key-touch sensations, key-touch responses and reactions, or resistances of keys being depressed) similar to those of acoustic upright pianos, while they are able to listen to sounds via speakers or headphone sets, for example.

Acoustic upright pianos have strings and dampers for stopping vibrations of strings, wherein dampers are normally forced to come into contact with strings by damper springs. When keys are depressed, dampers are moved to depart from strings against forces of damper springs. In contrast, electronic upright pianos do not have strings and dampers. Even in acoustic upright pianos, no damper is arranged for each of keys of a prescribed range of pitches, for example, each of twenty keys counted from the rightmost key having the highest pitch. Therefore, acoustic upright pianos contain keys associated with dampers and other keys that are not associated with dampers, wherein key-touch feelings may differ based on their actions as to whether or not dampers are arranged therefor.

FIG. 12 shows variations of key-touch feelings that depend upon whether or not dampers are arranged therefor. In a graph of FIG. 12, the horizontal axis represents distance (in units of millimeters) by which each key is depressed, and the vertical axis represents a force (or a weight in units of grams) required for depressing each key. Herein, a curve A represents variations of force required for depressing each of keys associated with dampers, and a dotted line B represents a certain level of force required for depressing each of keys not associated with dampers (e.g., a force required for depressing a specific key not associated with a damper in an acoustic upright piano, or a force required for depressing each of keys of an electronic upright piano).

That is, each of keys not associated with dampers can be depressed with substantially a certain level of force except an initial state thereof in depression, which is shown by the dotted line B in FIG. 12. In contrast, as shown in the curve A in FIG. 12, each of keys associated with dampers must be increased in depressing force particularly in the middle of a stroke in depression and then be decreased, which indicates a so-called escapement where a load of a hammer is not applied on the keys.

When a player (or a user) depresses a key associated with a damper with a finger in an acoustic upright piano, a certain key-touch feeling is applied to a finger. In contrast, an electronic upright piano does not contain dampers, therefore, a player (or a user) cannot enjoy feeling such key-touch feelings. Even in an acoustic upright piano in which keys of higher pitches are not associated with dampers, the player (or user) cannot experience key-touch feelings similar to those produced when depressing other keys associated with dampers.

SUMMARY OF THE INVENTION

It is an object of the invention to provide an upright keyboard instrument that can produce key-touch feelings similar to those of keys associated with dampers with respect to keys not associated with dampers.

This invention is applied to an upright keyboard instrument such as an upright piano and an electronic piano, wherein each of keys is interlocked with an action (mechanism) and a hammer assembly as well as a plate spring unit or a damper unit, which is interlocked with a loud pedal. When the key is depressed, the action is activated to drive the hammer assembly, thus producing a musical tone. Herein, the plate spring unit or the damper unit, which contains a plurality of plate springs arranged in conformity with an arrangement of keys, may normally regulate a range of rotation of a whippen, which is included in the action and is rotated upon depression of the key. When the loud pedal is depressed, regulation for the rotation of the whippen is released, so that sound becomes louder.

Specifically, when the player (or user) depresses the key to be pivotally moved, the backend portion of the key is moved upwards together with a capstan to push up the whippen, the backend portion of which is then brought into contact with a plate spring to produce a resistive force due to elasticity. Such a resistive force of the plate spring is transmitted to the player's finger depressing the key by way of the whippen and the key. When the player depresses the loud pedal with the foot, the plate spring interconnected with a loud pedal rod, which is moved downwards upon depression of the loud pedal, refuges downwards and is departed from the backend portion of the whippen, so that the plate spring does not come into contact with the whippen that is rotated upon depression of the key, thus causing a loudness effect.

Thus, it is possible to actualize real key-touch feelings when depressing keys whether or not they are associated with dampers, which may be very close or similar to key-touch feelings realized on keys of an acoustic upright piano and the like.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

This invention will be described in further detail by way of examples with reference to the accompanying drawings.

1. First Embodiment

Figure 1:
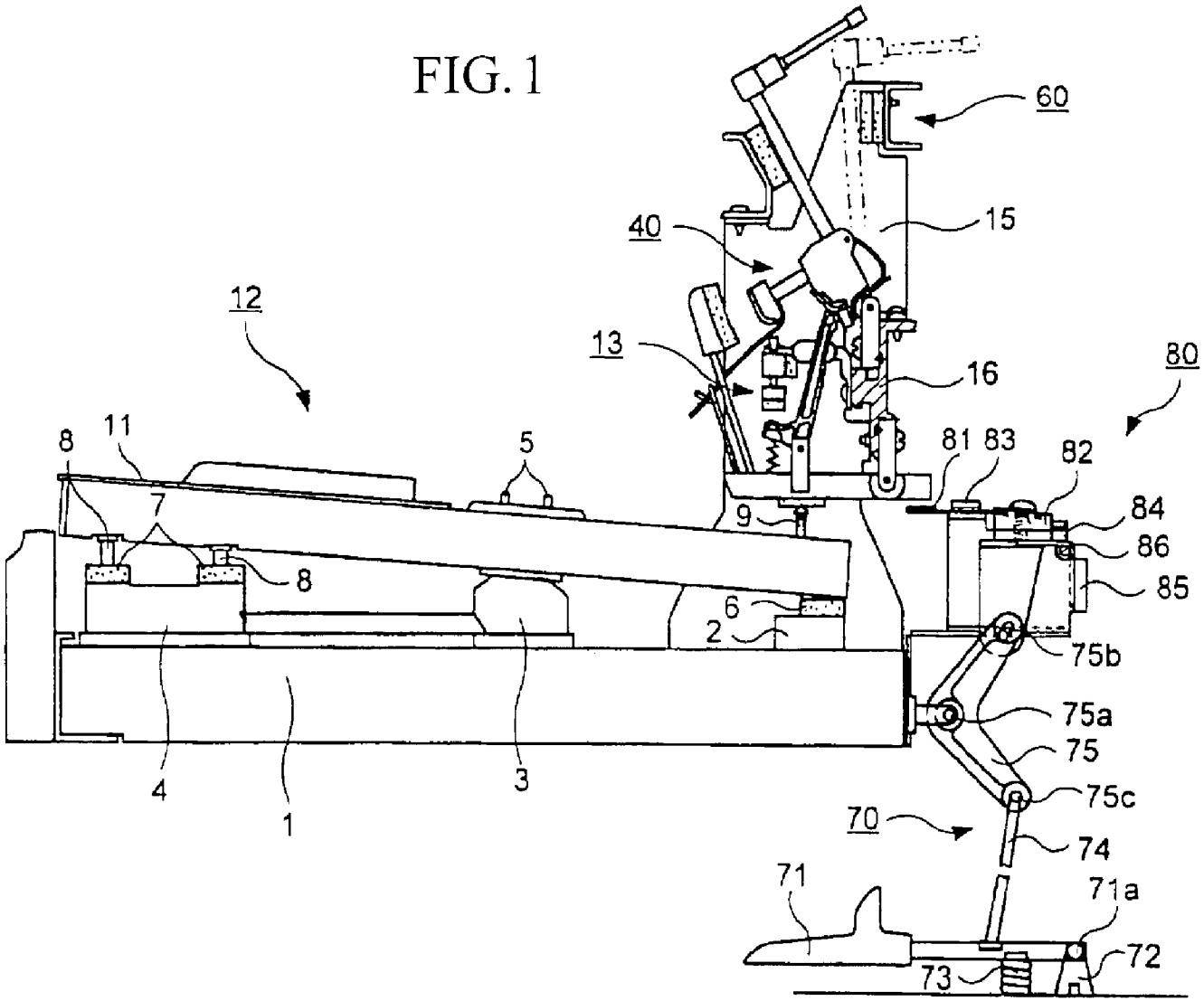
FIG. 1 is a cross sectional view showing the overall structure of an upright keyboard instrument in accordance with a first embodiment of the invention.

FIG. 1 is a cross sectional view showing the overall structure of an upright keyboard instrument in accordance with a first embodiment of the invention.

That is, a keyboard 12 has a prescribed number of keys 11, which are arranged to adjoin together in a direction perpendicular to a drawing sheet of FIG. 1. The keys 11 are arranged and supported on a keybed 1, which constructs a lower frame of the upright keyboard instrument. Three elongated members, that is, a back rail 2, a balance rail 3, and a front rail 4, are arranged at different positions on the upper surface of the keybed 1 along the overall width of the keyboard 12. The balance rail 3 acts as supporting points for the keys 11 respectively. Balance pins 5 are planted upwards at prescribed positions on the balance rail 3 in conformity with the keys 11 that are sequentially arranged to adjoin together. That is, the balance pins 5 are arranged to penetrate through prescribed positions of the keys 11, which are thus fixedly mounted on the balance rail 3. A cushion material 6 is affixed to the upper surface of the back rail 2, and cushion materials 7 are also affixed to the upper surface of the front rail 4. In addition, oval pins 8 are attached onto the front rail 4 via the cushion materials 7 in order to regulate left-right swing motions of the keys 11. Furthermore, capstans 9 are arranged to stand upon the upper surfaces of the keys 11 in backend portions (i.e., right-end portions of the keys 11 in FIG. 11). When the front end portion of the key 11 is depressed, the key 11 is rotatably moved about a supporting point corresponding to the contact area between the upper surface of the balance rail 3 and the backside of the key 11. Therefore, upon depression of the key 11, the capstan 9 is moved upwards together with the backend portion of the key 11.

In the keyboard 12, sensors (not shown) are arranged for the keys 11 to detect their movements. As sensors, it is possible to use piezoelectric elements, which are struck by the keys 11 respectively. Alternatively, it is possible to use optical sensors in which photo interrupters are arranged on the upper surface of the keybed 1, and shutters for blocking optical axes are arranged beneath the keys 11. In this case, key-depression velocities are measured based on time periods that are elapsed until light-receiving states are restored after optical axes are blocked by shutters. Output signals of sensors for detecting movements of the keys 11 are supplied to an electronic sound source (not shown).

The aforementioned upright keyboard instrument comprises hammer assemblies 40 and actions 13 in connection with the keys 11 of the keyboard 12. Both the hammer assemblies 40 and actions 13 are supported by a center rail 16, which is elongated over the entire width of the keyboard 12. Action brackets 15 are arranged at both end portions and intermediate portions of the center rail 16. That is, the hammer assemblies 40 and actions 13 are arranged between the action brackets 15.

Figure 2:
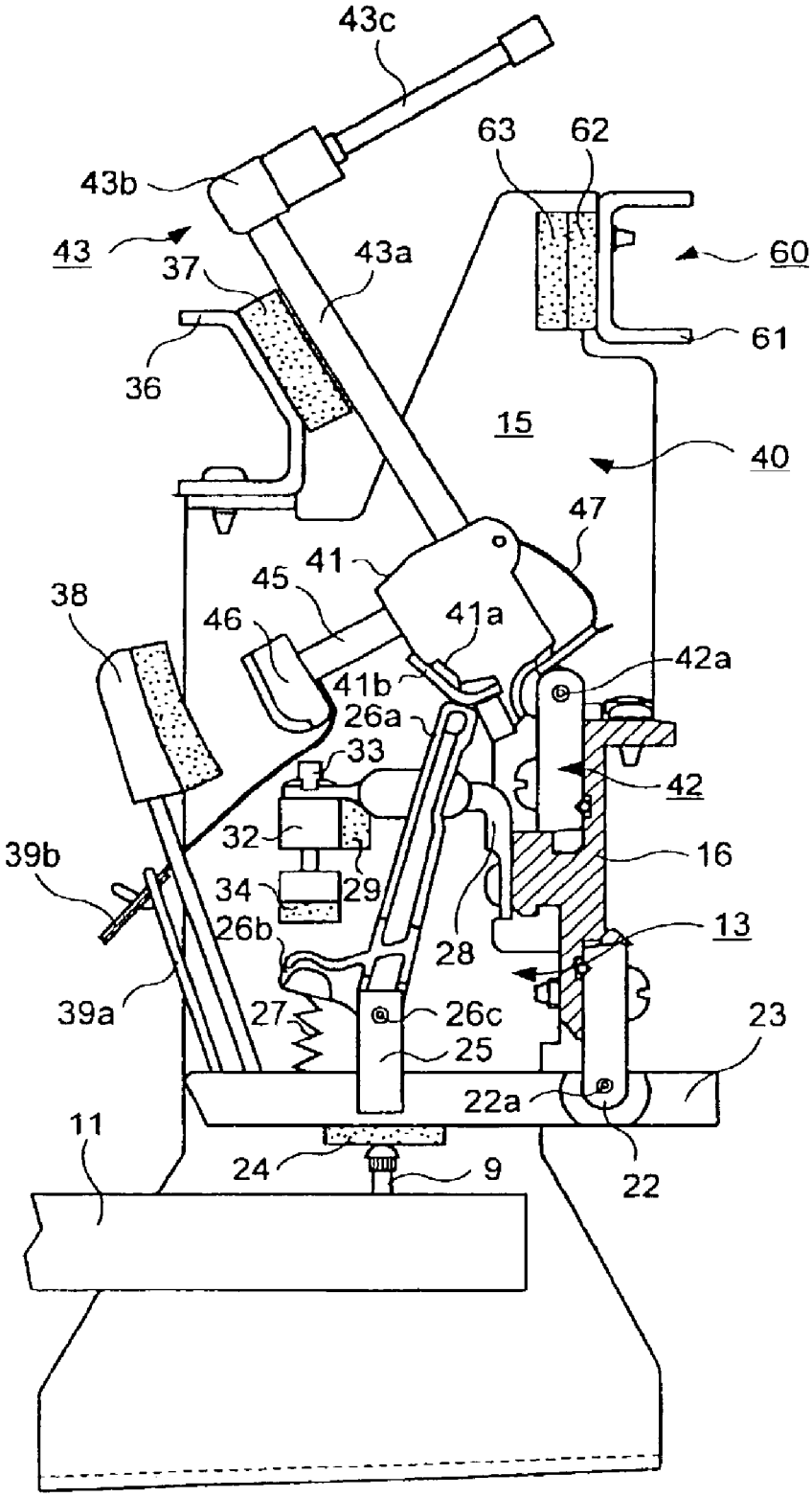
FIG. 2 is a cross section view showing a hammer assembly and an action (mechanism) contained in the upright keyboard instrument of FIG. 1.

FIG. 2 is a cross sectional view showing the detailed construction regarding the hammer assembly 40 and the action 13, wherein the hammer assembly 40 has a (hammer) butt 41 constructing a base portion thereof. The butt 41 is attached to a butt flange 42, which is affixed to the center rail 16, via a center pin 42*a*, about which it can be freely rotated. In addition, a butt under-felt 41 is attached to the lower surface of the butt 41 and is covered with a butt under-skin 41*b*.

A hammer 43 is interconnected with the hammer butt 41 in such a way that one end of a hammer shank 43*a* is fixed to the hammer butt 41. In addition, a connection member 43*b* is attached to the other end of the hammer shank 43*a* and is equipped with a weight member 43*c*, which is arranged perpendicular to the hammer shank 43*a* and is projected in a rotation direction (i.e., a clockwise direction in FIG. 2) of the hammer 43. A butt spring 47 is arranged on the right side of the butt 41 to normally press the hammer 43 in a counterclockwise direction. The aforementioned weight members 43*c* are respectively arranged for the hammers 43, which are arranged in conformity with the keys 11 having different pitches. In order to simulate characteristics of hammer felts arranged for hammers of an acoustic upright piano, the weight members 43*c* of the hammers 43 are sequentially modified or changed in sizes, shapes, and materials in such a way that the hammers 43 are gradually reduced in weights in the pitch ascending order from lower pitches to higher pitches.

One end of a catcher shank 45 is fixed to the butt 41 in a direction perpendicular to the hammer shank 43*a*, and the other end is equipped with a catcher 46.

A struck portion 60 is struck by the hammer shank 43*a* of the hammer assembly 40 when the key 11 is depressed. The struck portion 60 has a bracket 61, having a rectangular U-shape in cross section, which is elongated over the overall width of the keyboard 12. Preferably, the bracket 61 is made of a prescribed material such as cast iron having high damping effects. A damper member 62 composed of rubber or synthetic resin such as urethane is attached to one surface of the bracket 61. In addition, a buffer member 63 composed of rubber, synthetic resin, leather, cloth, and felt is attached to the surface of the damper member 62. When rotated in a clockwise direction, the hammer shank 43*a* is stopped in motion by the buffer member 63.

A hammer rail 36 is elongated over the entire width of the keyboard 12. A hammer pad 37 is attached to the surface of the hammer rail 36 to receive the hammer shank 43, thus avoiding bounce of hammer shank 43*a*. In a rest position of the key 11 that is not depressed, the hammer assembly 40 is forced to move in a counterclockwise direction due to the force of the butt spring 47, so that the hammer shank 43 is brought into contact with the hammer pad 37 attached to the hammer rail 36.

The action (or action mechanism) 13 is arranged to transmit motion of the key 11 to the hammer assembly 40. Now, the constitution of the action 13 will be described below.

A prescribed number of whippen flanges 22 are attached to the lower end portion of the center rail 16 at prescribed positions in proximity to the backend portions of the keys 11. Lower ends of the whippen flanges 22 are attached to prescribed positions close to end portions of whippens 23 via pins 22*a*. A whippen heel cloth 24 is attached to the backside of the whippen 23. Therefore, in a non-key-depression mode, the whippen 23 is maintained in a substantially horizontal condition while being supported by the head of the capstan 9 arranged on the backend portion of the key 11 by way of the whippen heel cloth 24.

A jack 26 is formed substantially in an L-shape and is constituted by a large jack portion 26*a* and a small jack portion 26*b*, which are combined together with substantially right angle therebetween. A jack flange 25 is attached to substantially the center portion of the whippen 23 and is arranged substantially vertical to the "horizontal" whippen 23. The upper end of the jack flange 25 is attached to a prescribed position close to a bent portion of the jack 26 via a pin 26*c*. Therefore, the jack 26 can be rotated about this pin 26*c;* however, rotation of the jack 26 is regulated by some members, which will be described below.

A jack spring 27 is arranged between the small jack portion 26*b* and the front portion of the whippen 23. In addition, a counterclockwise rotation of the large jack portion 26*a* is regulated by a regulating rail 32. That is, a jack stop felt 29 is adhered to the surface of the regulating rail 32, which is arranged opposite to the large jack portion 26*a*, wherein the regulating rail 32 is connected with the center rail 16 via a regulating bracket 28. Under the aforementioned regulation, the jack 26 is initially positioned in such a way that the tip end of the large jack portion 26*a* is brought into contact with the butt under-skin 41*b,* which is attached to the lower surface of the butt 41 of the hammer assembly 40, so that the butt 41 is pressed obliquely thereunder by the tip end of the large jack portion 26*a*.

When the key 11 is depressed and is pivotally moved about the balance rail 3, the backend portion of the key 11 is moved upwards together with the capstan 9, which correspondingly pushes the front end portion of the whippen 23 via the whippen heel cloth 24, so that the whippen 23 is forced to rotate about the pin 22*a* in a clockwise direction. Due to the rotation of the whippen 23, the large jack portion 26*a* obliquely pushes up the lower portion of the butt 41, so that the hammer 43 is rotated in a clockwise direction. A regulating button 34 is arranged below and attached to the regulating rail 32 in order to regulate upward movement of the small jack portion 26*b*. That is, when the front end portion of the whippen 23 is rotated to a prescribed position, the tip end of the small jack portion 26*b* is brought into contact with the lower surface of the regulating button 34 and is stopped in upward movement thereof. Incidentally, the position of the regulating button 34, which is arranged between the regulating rail 32 and the small jack portion 26*b*, can be adjusted vertically by operating a screw 33.

A back check 38 is attached to the front end (or free end) of the whippen 23 in order to elastically receive the catcher 46 of the hammer assembly 40 which is restored to a rest position. In addition, a bridle wire 39*a* is arranged in connection with the back check 38, wherein the upper end of the bridle wire 39*a* is interconnected with the catcher 46 via a bridle tape 39*b*. The bridle tape 39*b* controls the restoration of the hammer assembly 40 to follow up with the restoration of the whippen 23, thus avoiding double strike actions in which the hammer shank 43*a* strikes the struck portion 60 twice due to bounce of the hammer assembly 40.

The player (or user) of an acoustic upright piano is not always required to drive the action and hammer assembly but is also required to drive the damper when depressing a key with a finger. For this reason, the player must strongly depresses the key with a finger. In other words, in the acoustic upright piano, the action and hammer assembly as well as the damper cooperate together to exert resistance to the player's finger depressing the key. The upright keyboard instrument of the present embodiment does not contain dampers. Instead, the present embodiment provides a means for exerting resistance against the player's finger depressing the key, that is, a plate spring unit 80 shown in FIGS. 1 and 3. In addition, the present embodiment also provides a switching means for switching over the operation of the plate spring unit 80 whether to exert resistance against the player's finger depressing the key or not, that is, a loud pedal unit 70 shown in FIG. 1.

Figure 4:
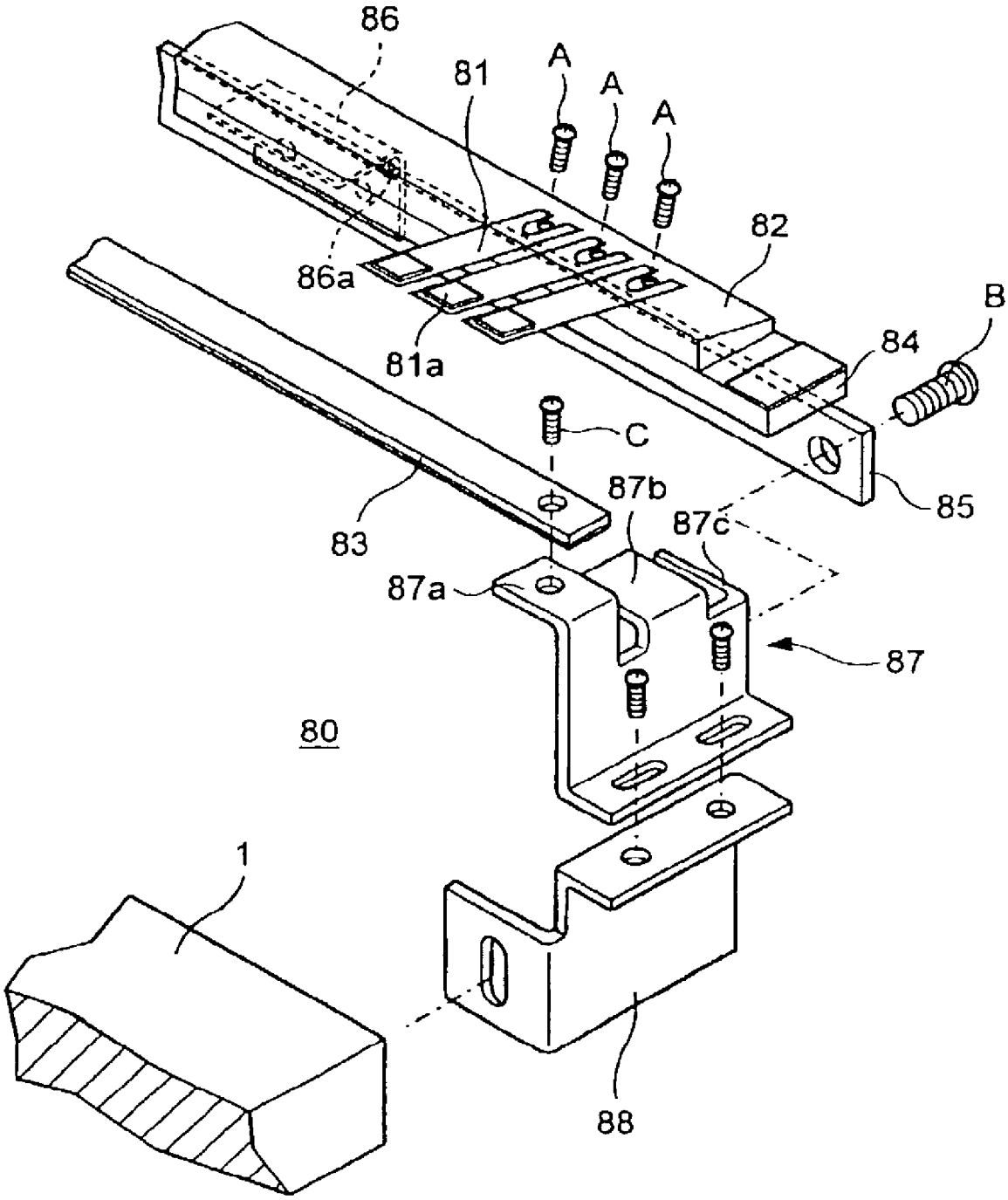
FIG. 4 is an exploded perspective view showing parts of a plate spring unit, which are assembled together.
Figure 5:
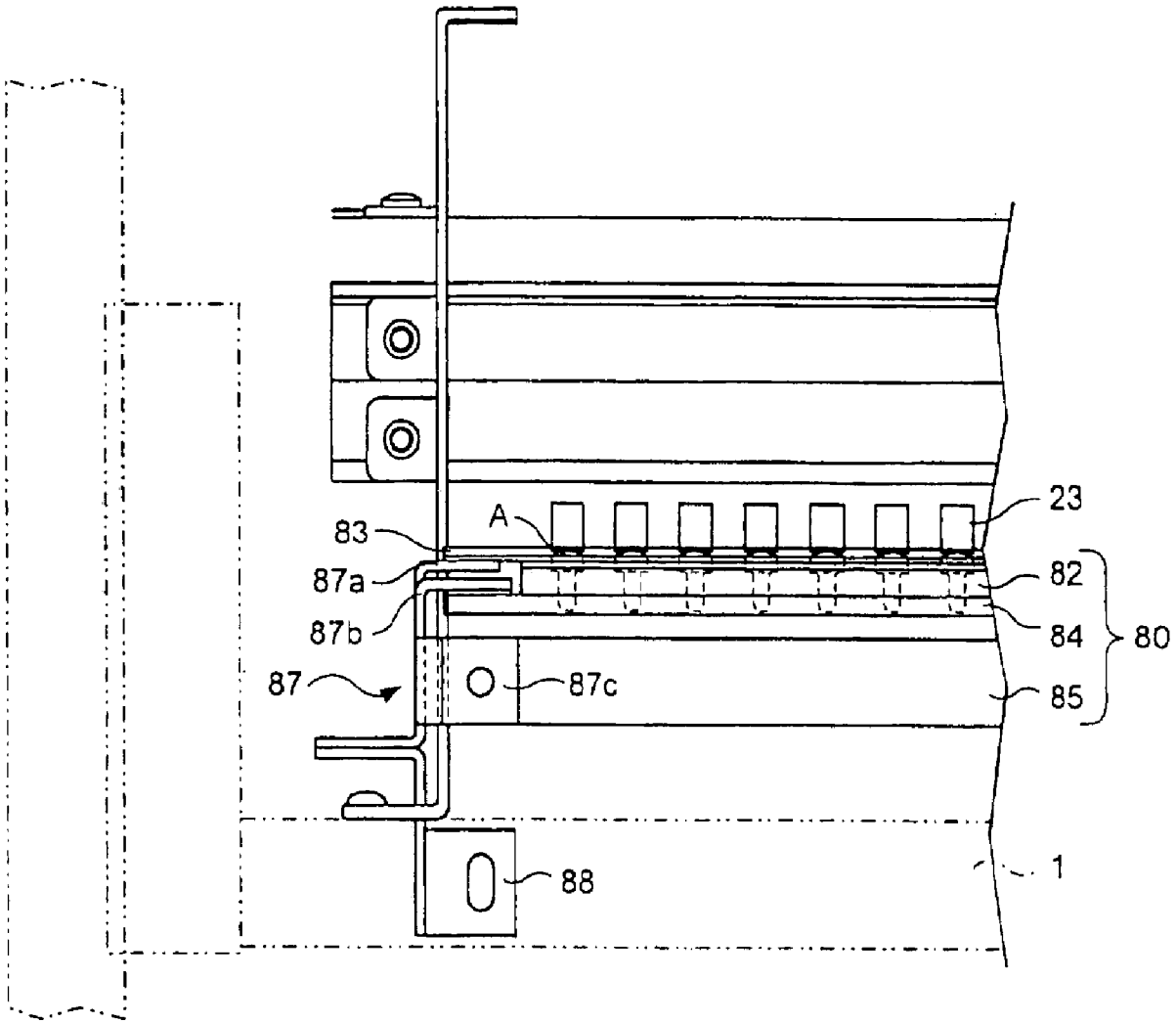
FIG. 5 is a rear view of the upright keyboard instrument, in which the plate spring unit is arranged.

FIG. 4 is an exploded perspective view showing parts of the plate spring unit 80, which are assembled together. FIG. 5 is a rear view of the upright keyboard instrument which is equipped with the plate spring unit 80. Two metal members 88 (each shown in FIG. 4) are fixed to both the left end portion and right end portion of the keybed 1 in the rear side of the upright keyboard instrument. Plate spring mounting members 87 are screwed to the upper portions of the metal members 88, which are fixed to the keybed 1.

The plate spring mounting members 87 have mount portions 87*a* and vibration stoppers 87*b* respectively. Herein, both ends of a plate spring presser 83 are fixed to the mounting portions 87*a* of the plate spring mounting members 87 via screws C.

As shown in FIG. 5, tapped holes 87*c* having internal threads are respectively formed to penetrate through prescribed surfaces of two plate spring mounting members 87 in the rear side of the upright keyboard instrument, while through holes are correspondingly formed at both ends of a hinge fixing plate 85. Therefore, screws B are inserted into the through holes of the hinge fixing plate 85 and are then engaged with the tapped holes 87*c* of two plate spring mounting members 87, so that both ends of the hinge fixing plate 85 are securely fixed to two plate spring mounting members 87. When fixed as described above, the hinge fixing plate 85 is maintained to be substantially in parallel with the real surface of the upright keyboard instrument. A vibration plate 84 is an elongated rectangular plate whose length substantially matches the overall width of the keyboard 12. This vibration plate 84 is fixed to the hinge fixing plate 85 by means of a hinge 86, each of which has two blades that can rotate about a same rotation shaft 86*a*, wherein one blade is fixed to the lower surface of the vibration plate 84 while the other blade is fixed to the surface of the hinge fixing plate 85. Therefore, the vibration plate 84 can be pivotally moved about the rotation shaft 86*a* of the hinge 86. Downward movement of the vibration plate 84 is stopped by the vibration stoppers 87*b* of the plate spring mounting members 87.

A plate spring fixing rail 82 is fixed to the upper surface of the vibration plate 84. In addition, a prescribed number of plate springs 81 are arranged on the upper surface of the plate spring fixing rail 82 in conformity with an arrangement of the keys 11 in the keyboard 12. Cushions 81*a* are adhered to upper surfaces of tip end portions of the plate springs 81 respectively. Furthermore, cutouts are formed at backend portions of the plate springs 81, and tapped holes having internal threads are correspondingly formed at prescribed positions of the plate spring fixing rail 82. That is, the plate springs 81 are respectively fixed to the plate spring fixing rail 82 in such a way that screws A are inserted into cutouts of the plate springs 81 and are engaged with the tapped holes of the plate spring fixing rail 82. The aforementioned plate spring presser 83 are fixed onto the plate spring mounting members 87 so as to press the plate springs 81 fixed to the plate spring fixing rail 82 thereunder. In this state, the tip end portions of the plate springs 81 are arranged outside of the plate spring presser 83, which is shown in FIG. 3.

Normally, the plate springs 81 are maintained in positions (see FIG. 3) in such a way that the cushions 81 attached to the tip end portions thereof are arranged opposite to the lower surface of the backend portion of the whippen 23. When the key 11 is placed in a rest position, the lower surface of the backend portion of the whippen 23 is slightly floated above the cushions 81*a* of the plate springs 81.

Figure 3:
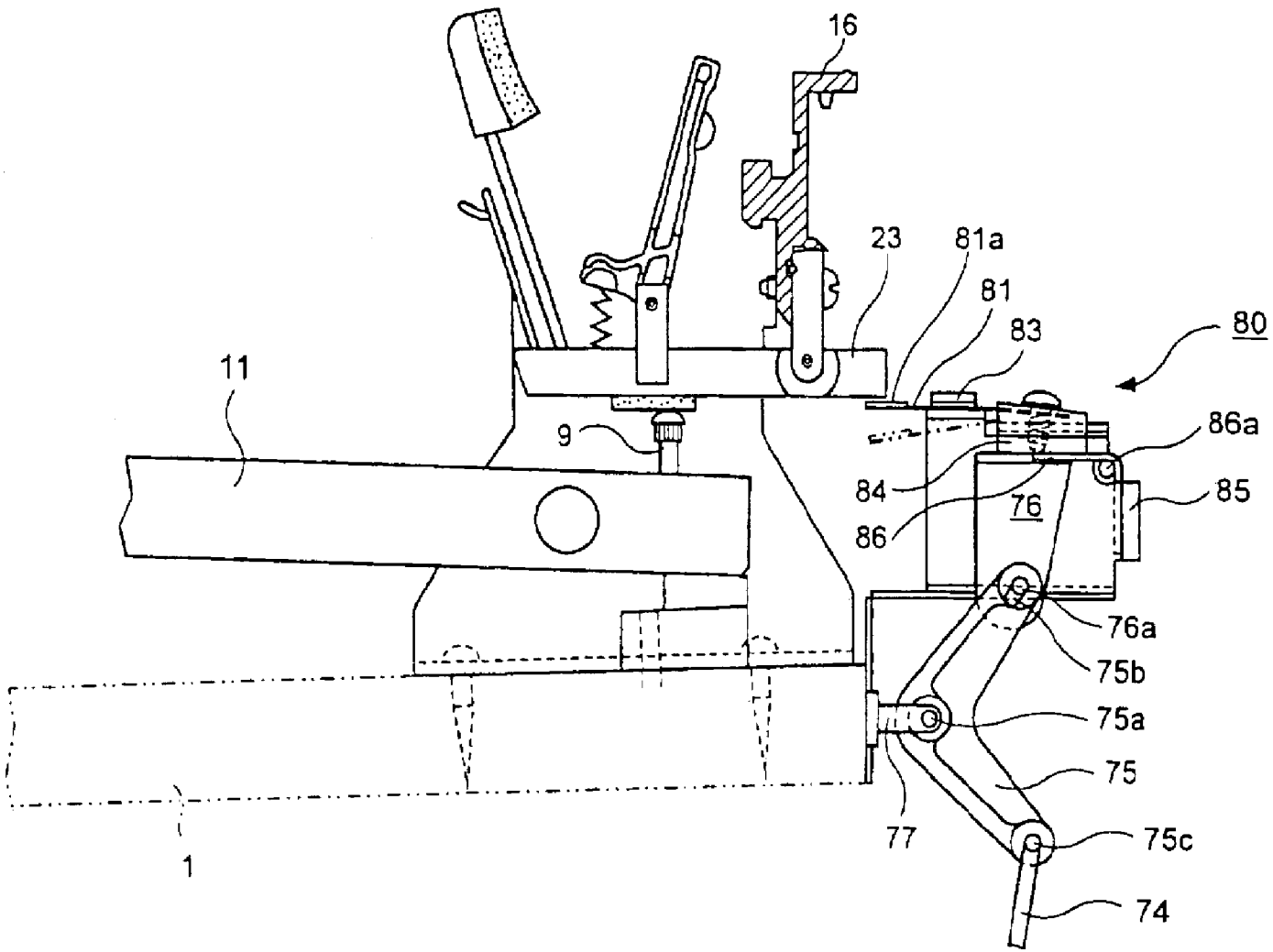
FIG. 3 is a cross sectional view showing a positional relationship between a plate spring and a whippen included in the action.

A link member 76 is arranged and is extended downwards from the lower surface of the vibration plate 84 as shown in FIG. 3, wherein a shaft 76*a* is projected from the surface of the lower end portion of the link member 76. As described above, the vibration plate 84 can be pivotally moved about the shaft 86*a* of the hinge 86. Therefore, the shaft 86*a* of the link member 86 can be moved along an orbit of a circle having a prescribed radius about the shaft 86*a* of the hinge 86.

Next, the constitution of the loud pedal unit 70 will be described in detail with reference to FIG. 1. The backend portion of a loud pedal 71 (see lower right section in FIG. 1) is interconnected with a support base 71 via a rotation shaft 71*a*. In addition, a pedal spring 73 is attached to the lower surface of the loud pedal 71 close to its center portion, so that the loud pedal 71 is normally pressed upwards by the pedal spring 73. Furthermore, a loud pedal rod 74 is attached to a prescribed position, which is closer to the center portion compared with the pedal spring 73, on the upper surface of the loud pedal 71.

When the front portion of the loud pedal 71 is depressed downwards against the force of the pedal spring 73, it is rotated about the rotation shaft 71*a* in a counterclockwise direction, so that the loud pedal rod 74 is correspondingly lowered in position. After depression of the loud pedal 71 is released, the loud pedal 71 is restored to the initial position due to the force of the pedal spring 73.

A sensor (not shown) is arranged to detect movement of the loud pedal 71, so that an output signal thereof is supplied to an electronic sound source (not shown).

In addition to the aforementioned parts, the loud pedal unit 70 comprises a specific structure for transmitting depressing motion of the loud pedal 71 to the plate spring unit 80. That is, a fixing member 77 (see FIG. 3) is attached to the terminal portion of the keybed 1 in the rear side of the upright keyboard instrument, and it is constituted by a rotation arm 75, which is bent roughly in a V-shape and whose center is pivotally supported by a rotation shaft 75*a*. The lower end portion of the rotation arm 75 is interconnected with the upper end portion of the loud pedal rod 74 via a shaft 75*c*. In addition, an elongated hole 75*b* is formed at the upper end portion of the rotation arm 75. The aforementioned shaft 76*a* that is projected from the lower end portion of the link member 76 is inserted into the elongated hole 75*b* of the rotation arm 75.

Next, the overall operation of the present embodiment will be described in detail.

When the key 11 is depressed so that the backend portion of the key 11 is moved upwards together with the capstan 9, the whippen 23 is pushed up by the capstan 9 via the whippen heel cloth 24, so that the whippen 23 is rotated about the pin 22*a* in a counterclockwise direction (see FIG. 2). Therefore, the large jack portion 26*a* pushes up the butt 41 to cause clockwise rotation in the hammer assembly 40, so that the hammer shank 43*a* strikes the struck portion 60. In this case, the motion of the depressed key 11 is detected by the foregoing sensor to produce a key-depression signal, which is sent to the electronic sound source. As a result, the speaker(s) or headphone set produces a musical tone having a pitch corresponding to the key 11 and a tone volume corresponding to the intensity of depressing the key 11.

Then, the key 11 is released, so that the sensor outputs a key-release signal to the electronic sound source, which in turns performs a damping process (or a muting process) to rapidly reduce the tone volume of the musical tone corresponding to the key 11. This process may correspond to the operation of a damper used in an acoustic upright piano. Such a damping process can be performed inside of the electronic sound source, or it can be realized by an effector that is arranged to follow the electronic sound source, for example.

In response to the depression of the key 11, the present embodiment performs the following operation in addition to the aforementioned operation. That is, when the whippen 23 is rotated about the pin 22*a* in a clockwise direction due to the depression of the key 11, the lower surface of the backend portion of the whippen 23 (see FIG. 3) comes in contact with the cushion 81*a* arranged on the tip end portion of the plate spring 81, which is then lowered in position. At this time, the elasticity of the plate spring 81 causes resistive force to push up the backend portion of the whippen 23. This resistive force is transmitted to the player's finger depressing the key 11 by way of the whippen 23 and the key 11. Therefore, the player can feel key-depression feeling or resistance in depressing the key 11 with his/her finger, which may be similar to a key associated with a damper in an acoustic upright piano.

Specifically, the present embodiment is designed in such a way that the cushion 81*a* of the plate spring 81 is arranged with a distance of approximately 1.4 mm below the lower surface of the backend portion of the whippen 23 placed in a rest position. By carefully arranging the cushion 81*a* of the plate spring 81 with the aforementioned dimension, the whippen 23 is not affected by the resistive force of the plate spring 81 in a certain time period ranging from a key-depression start timing at which the whippen 23 starts to rotate about the pin 22*a* to a prescribed timing at which the lower surface of the backend portion of the whippen 23 comes in contact with the cushion 81*a* of the plate spring 81, so that the whippen 23 can be freely rotated without being affected by the resistive force of the plate spring 81. That is, it is possible to adjust the time period in which the resistive force caused by the plate spring 81 is not transmitted to the player's finger depressing the key 11. Therefore, it is possible to actualize key-depression feeling similar when the player depresses the key 11 with a finger, which is very close to key-depression feeling realized when depressing a key associated with a damper in an acoustic upright piano, for example.

Next, when the loud pedal 71 is depressed, the foregoing sensor produces and outputs a pedal-depression signal to the electronic sound source. In addition, the loud pedal rod 74 is lowered in position due to the depression of the loud pedal 71, so that the shaft 75*c* of the rotation arm 75 interconnected with the loud pedal rod 74 is pulled downwards obliquely in the left side of FIG. 2. This causes a clockwise rotation on the rotation arm 75 about the rotation shaft 75*a*. That is, when the rotation arm 75 is rotated in the clockwise direction, the elongated hole 75*b* formed in the upper end portion of the rotation arm 75 is moved in a counterclockwise direction. Due to such a counterclockwise movement of the elongated hole 75*b* of the upper end portion of the rotation arm 75, the shaft 76 projected from the surface of the lower end portion of the link member 76 is moved downwards while being guided along the elongated hole 75*b*. As a result, the vibration plate 84 and the plate spring 84 fixed to the vibration plate 84 are both rotated about the shaft 86*a* of the hinge 86 in a counterclockwise direction. Thus, the plate spring unit 80 is lower in position so that the tip end portion of the plate spring 81 is moved downwards to be lower than a prescribed range of rotation of the whippen 23.

When the key 11 is depressed under the aforementioned state where the plate spring unit 80 is lowered in position due to the depression of the loud pedal 71, the backend portion of the whippen 23 can be rotated freely without being in contact with the tip end portion of the plate spring 81. Therefore, it is possible to actualize key-touch feeling when the player depresses the key 11 with a finger, which may be very close to key-touch feeling realized when depressing a key while depressing a loud pedal in an acoustic upright piano.

When the key 11 is released, the sensor produces and outputs a key-release signal to the electronic sound source. In this case, the electronic sound source does not perform a damping (or muting) process to rapidly reduce the tone volume of the musical tone presently produced. That is, the musical tone is sustained for a while with a relatively large tone volume and is then gradually reduced in tone volume.

When the player removes the foot from the loud pedal 71, the loud pedal rod 74 is raised upwards to cause a counterclockwise rotation on the rotation arm 75 about the rotation shaft 75*a*. Due to such a rotation of the rotation arm 75, the elongated hole 75*b* of the upper end portion of the rotation arm 75 is moved in a clockwise direction, so that the shaft 76*a* arranged in the lower end portion of the link member 76 is pushed upwards while being guided along the elongated hole 75*b*. Thus, the vibration plate 84 is rotated about the shaft 86*a* of the hinge 86 in a clockwise direction so that the plate spring unit 80 is slightly moved upwards, wherein the tip end portion of the plate spring 81 is restored to its initial position and is moved close to the lower surface of the backend portion of the whippen 23. The operation and effect of the action 13 interlocked with the key 11 being depressed have been already described with respect to depression of the key 11 in the aforementioned condition where the loud pedal 71 is not depressed or released.

The present embodiment can be modified in various ways, examples of which will be described below.

Figure 6:
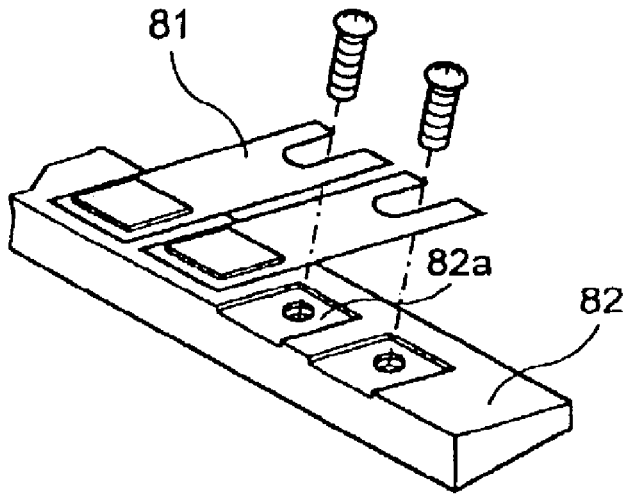
FIG. 6 is a perspective view showing an example of a structure for fixing plate springs onto a plate spring fixing rail contained in a plate spring unit, which is arranged in a rear side of an upright keyboard instrument.
Figure 7:
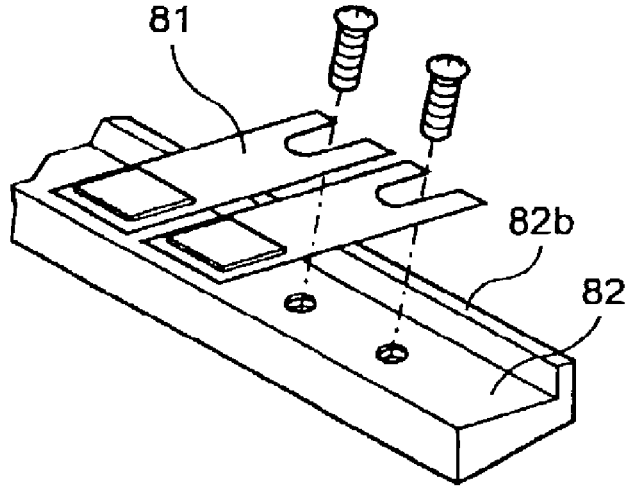
FIG. 7 is a perspective view showing another example of the structure for fixing plate springs onto a plate spring fixing rail.
Figure 8:
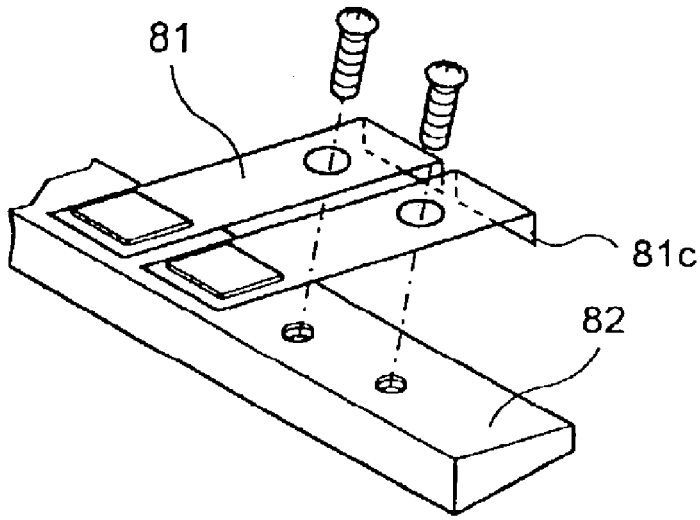
FIG. 8 is a perspective view showing a further example of the structure for fixing plate springs onto a plate spring fixing rail.

That is, it is possible to provide various types of structures, shown in FIGS. 6 to 8, for fixing the plate springs 81 to the plate spring fixing rail 82. In the structure of FIG. 6, hollows 82*a* whose shapes match shapes of the plate springs 81 are formed on the upper surface of the plate spring fixing rail 82, so that one ends of the plate springs 81 are engaged with the hollows 82*a* and are fixed to the plate spring fixing rail 82 via screws. In the structure of FIG. 7, an elongated projection 82*b* is formed on one end of the plate spring fixing rail 82 along its longitudinal direction, so that the backends of the plate springs 81 are brought into contact with the wall of the elongated projection 82*b*, so that the plate springs 81 are fixed to the plate spring fixing rail 82 via screws. In the structure of FIG. 8, hooks 81*c* are formed on one ends of the plate springs 81 and are hooked on one side of the plate spring fixing rail 82, so that the plate springs 81 are fixed to the plate spring fixing rail 82 via screws. By adapting the aforementioned structures, it is possible to reliably prevent the plate springs 81 from being unexpectedly shifted in positions when being depressed by the whippen 23. By avoiding occurrence of positional shifts or deviations of the plate springs 81, it is possible to reduce loss of the force that the whippen 23 imparts to the plate springs 81. Thus, it is possible to stabilize resistive forces produced by the plate springs 81.

2. Second Embodiment

Figure 9:
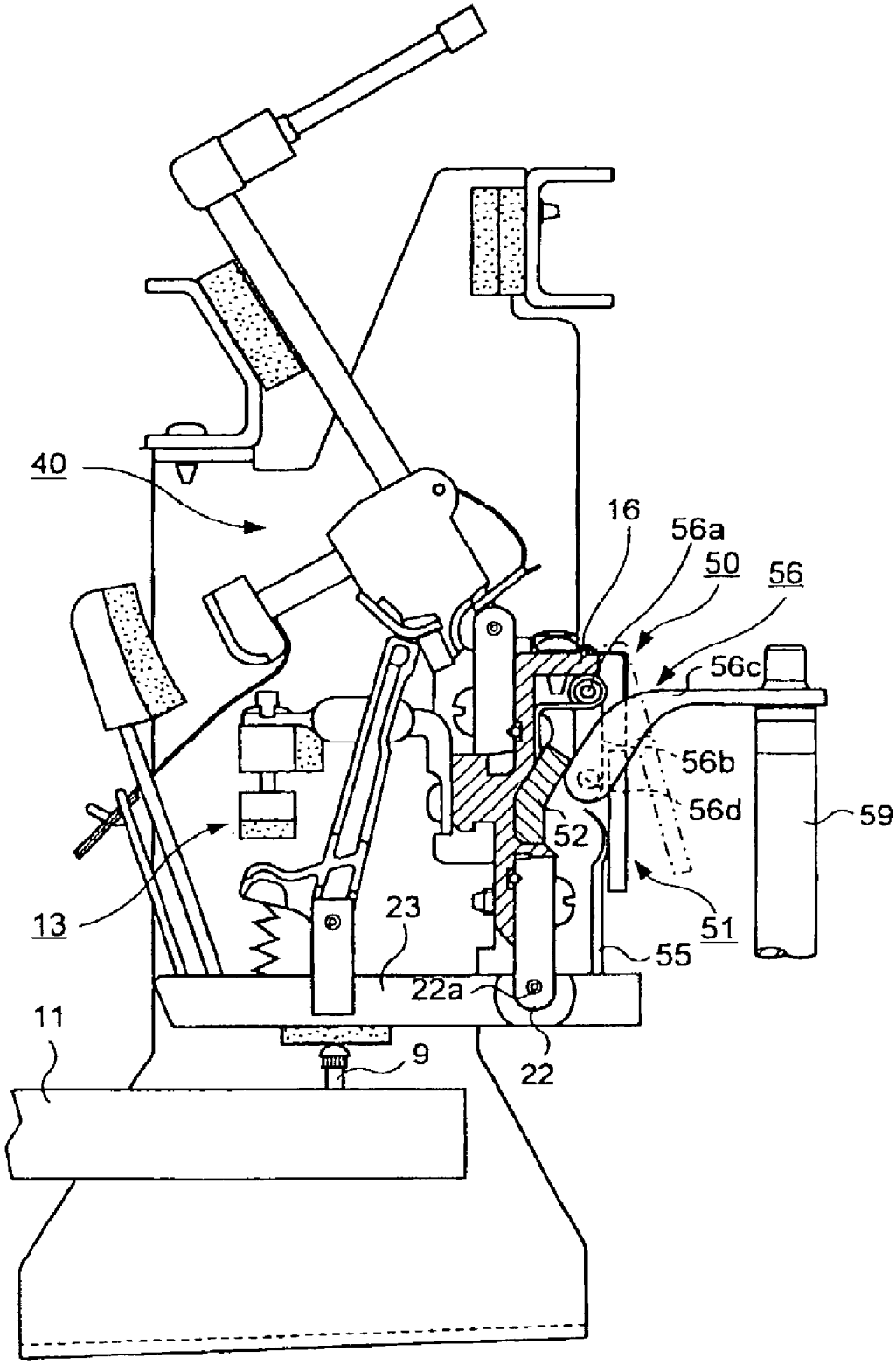
FIG. 9 is a cross sectional view showing essential parts of an upright keyboard instrument in accordance with a second embodiment of the invention.
Figure 10:
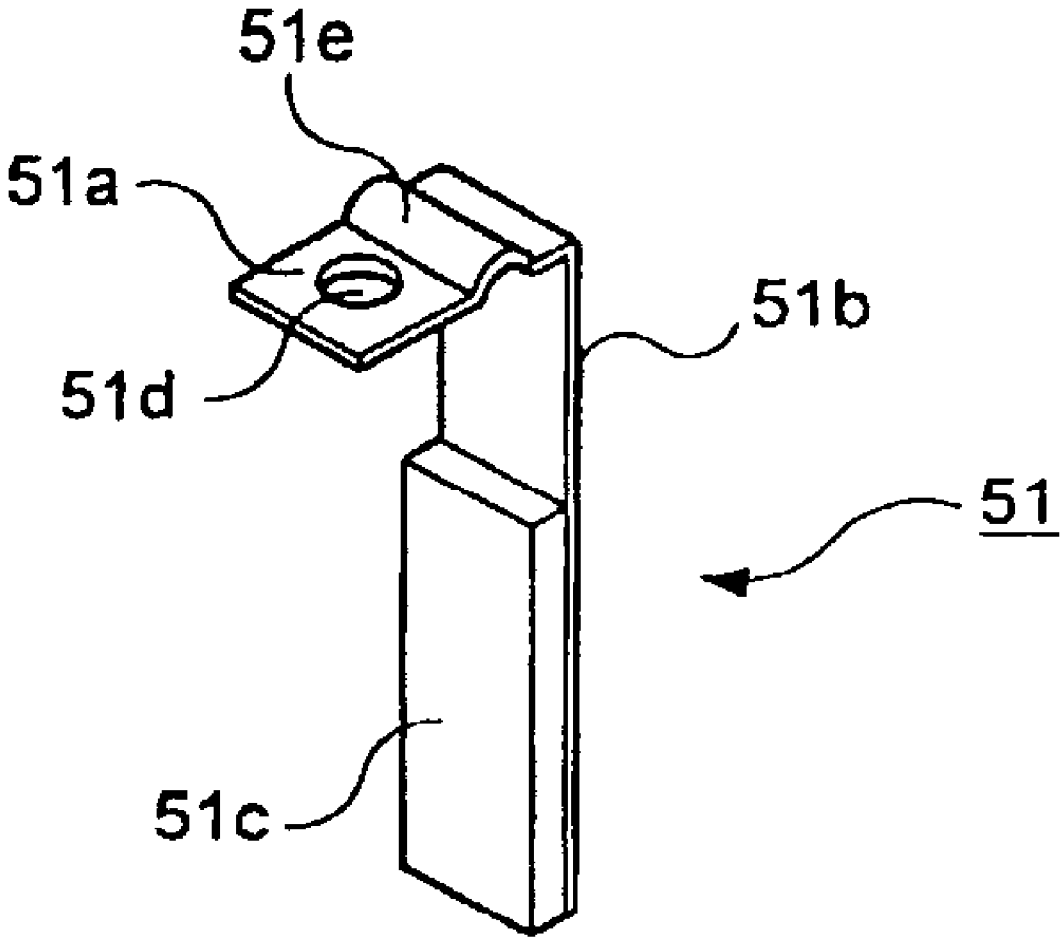
FIG. 10 is a perspective view showing the structure of a plate spring installed in a damper unit included in the upright keyboard instrument of FIG. 9.

Next, an upright keyboard instrument according to a second embodiment of the invention will be described with reference to FIGS. 9 and 10. FIG. 9 is a cross sectional view showing essential parts of the upright keyboard instrument of the second embodiment, which is characterized by not using the aforementioned plate spring unit 80, which is replaced with a damper unit 50. The damper unit 50 comprises a damper spoon 55, a plate spring 51, a damper rod 56, and a damper rod under-felt 52.

As shown in FIG. 9, the damper spoon 55 is constituted by a round bowl whose bottom is directed to the rear side of the upright keyboard instrument and a handle that is fixed to stand vertically on a prescribed position of the upper surface of the backend portion of the whippen 23. The plate spring 51 regulates the bowl of the damper spoon 55 from the rear side of the upright keyboard instrument, wherein one end of the plate spring 51 is attached to the center rail 16. Specifically, the plate spring 51 is designed as shown in FIG. 10, wherein it comprises a fixing portion 51*a* arranged on the upper surface of the center rail 16 and a contact portion 51*b* formed substantially perpendicular to the fixing portion 51*a*. The fixing portion 51*a* has a convex 51*e* for sustaining the elasticity of the plate spring 51 and a hole 51*d* allowing insertion of a screw. That is, the fixing portion 51*a* of the plate spring 51 is fixed to the upper surface of the center rail 16 by inserting a screw into the hole 51*d*. A felt 51*c* is attached to the surface of the contact portion 51*b*, so that the bottom of the bowl of the damper spoon 5 is brought into contact with the felt 51*c*.

In FIG. 9, the damper rod 56 comprises a rotation shaft 56*a* fixed to the center rail 16, a damper rod shaft 56*b*, and a lever 56*c*. One end of the damper rod shaft 56*b* is connected with the rotation shaft 56*a*, so that the damper rod shaft 56*b* can be rotated about the rotation shaft 56*a*. The other end of the damper rod shaft 56*b* is equipped with a connection shaft 56*d*. One end of the lever 56*c* is interconnected with the upper end of a loud pedal rod 59, which is moved upwards when a loud pedal (not shown) is depressed by a player's foot and is then moved downwards when released. The lever 56*c* is formed to be gradually bent downwards from the middle portion thereof, and the other end of the lever 56*c* opposite to the loud pedal rod 59 is connected with the connection shaft 56*d* of the damper rod shaft 56*b*. The damper rod under-felt 52 is fixed to the center rail 16 in such a way that one end thereof is brought into contact with the other end of the lever 56*c*. This damper rod under-felt 52 is arranged to regulate the initial position of the lever 56*c* when restored and to avoid occurrence of noise.

Next, a description will be given with respect to the operation of the second embodiment. In FIG. 9, when the key 11 is depressed so that the backend portion thereof is moved upwards together with the capstan 9, the front end portion of the whippen 23 is rotated about the pin 22*a* and is slightly moved upwards, so that the bottom of the bowl of the damper spoon 55, which vertically stands on the upper surface of the backend portion of the whippen 23 that is moved downwards, is moved rightward to press the plate spring 51, which is thus elastically deformed. At this time, a resistive force for restoring the lowering of the backend portion of the whippen 23 occurs due to the elasticity of the plate spring 51. Such a resistive force is transmitted to the player's finger depressing the key 11 by way of the whippen 23 and the key 11. Thus, it is possible to actualize key-touch feeling when the player depresses the key 11, which may be very close to key-touch feeling realized on a key associated with a damper in an acoustic upright piano.

When the player depresses the loud pedal with the foot so that the loud pedal rod 59 is moved upwards, one end of the lever 56*c* is moved upwards so that the connection shaft 56*d* connected with the other end of the lever 56*c* is obliquely pulled upwards. As a result, the damper rod shaft 56*b* is rotated about the rotation shaft 56*a* in a counterclockwise direction, so that the tip end portion of the damper rod shaft 56*b* pushes the plate spring 51, which is moved rightwards as shown by dotted lines in the rear side of the upright keyboard instrument. Thus, the contact portion 51*b* of the plate spring 51 moves or escapes outside of a prescribed range of rotation of the damper spoon 55.

When the key 11 is depressed in the aforementioned condition where the loud pedal is depressed, the whippen 23 rotates about the pin 22*a* so that the damper spoon 55 is moved rightward; however, the bowl of the damper spoon 55 does not come in contact with the felt 51*c* of the contact portion 51*b* of the plate spring 51, which moves or escapes as shown by dotted lines in FIG. 9. Therefore, it is possible to actualize key-touch feeling when the player depresses the key 11 with a finger, which may be very close to key-touch feeling realized on a key of an acoustic upright piano upon depression of a loud pedal.

When the player removes the foot from the loud pedal so that the loud pedal rod 59 interconnected with one end of the lever 56*c* is moved downwards, the connection shaft 56*d* connected with the other end of the lever 56*c* is obliquely pulled downwards, so that the damper rod shaft 56*b* rotates about the rotation shaft 56*a* in a clockwise direction and is restored to the initial position thereof. At this time, the plate spring 51 is restored to the initial position thereof due to the elasticity thereof, so that the felt 51*c* of the contact portion 56*b* is brought into contact with the bottom of the bowl of the damper spoon 55 again. The overall operation of the action 13 and the damper unit 50 has been already described with respect to depression of the key 11 in the aforementioned condition where the loud pedal is not depressed or released.

3. Third Embodiment

In an acoustic upright piano, approximately twenty keys belonging to a high-pitch register of higher pitches counted from the highest pitch are not associated with dampers respectively. This causes different key-touch feelings between the high-pitch register and other register(s) upon depressions of keys. The third embodiment is designed to actualize similar key-touch feelings between the high-pitch register whose keys are not associated with dampers and the other register whose keys are associated with dampers in an acoustic upright piano, for example.

Figure 11:
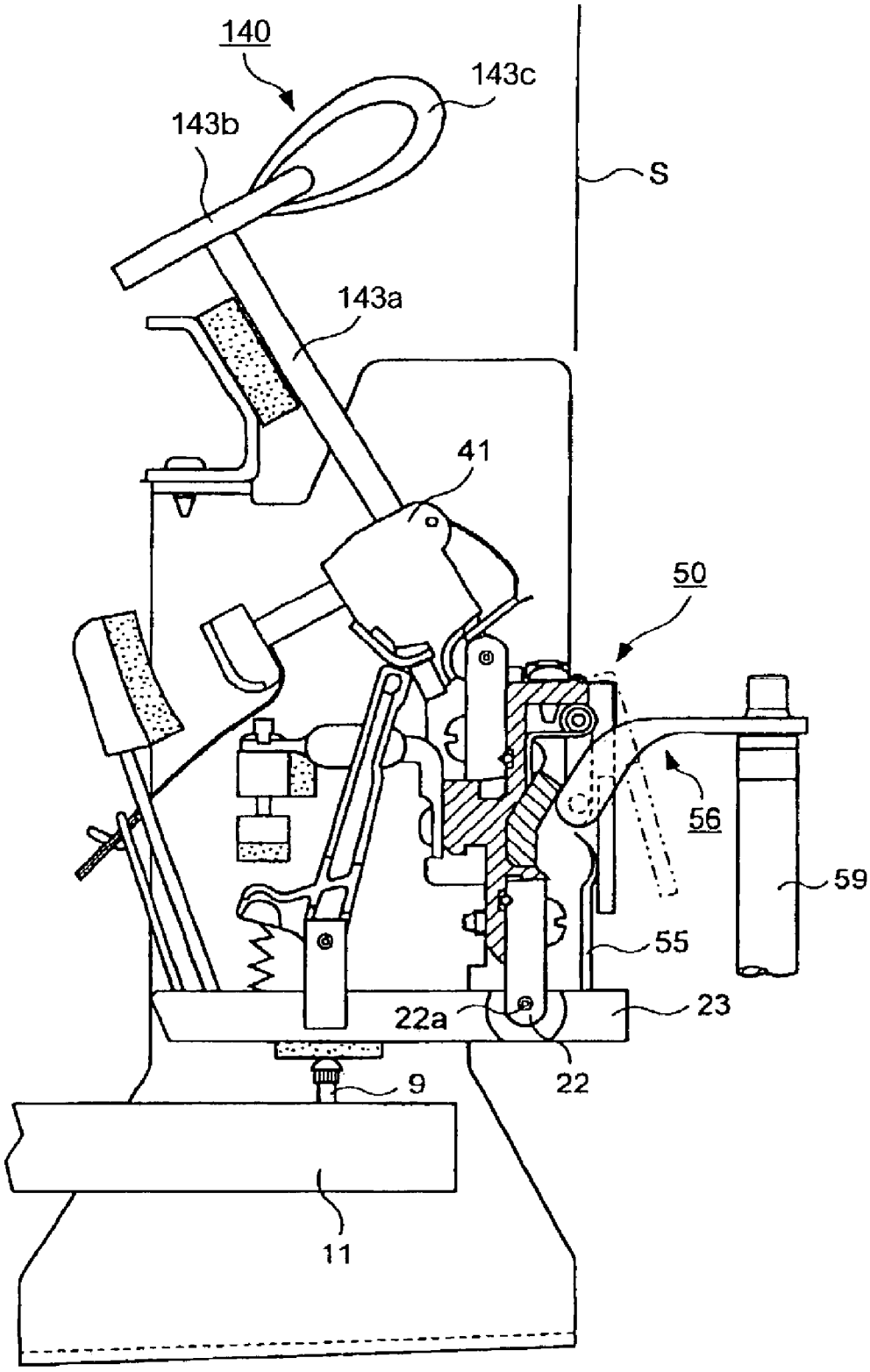
FIG. 11 is a cross sectional view showing essential parts of an upright keyboard instrument in accordance with a third embodiment of the invention.
Figure 12:
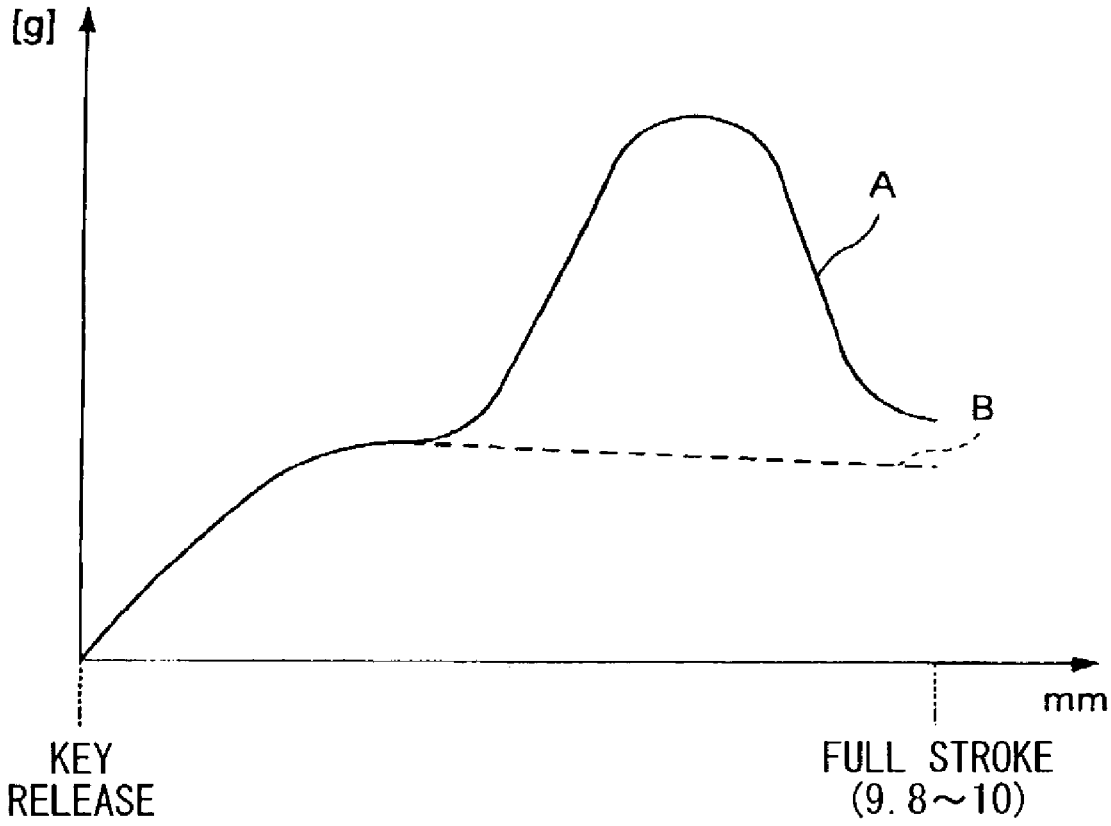
FIG. 12 is a graph showing differences of key-touch feelings between keys associated with dampers and keys not associated with dampers.

FIG. 11 is a cross sectional view showing essential parts of an upright keyboard instrument in accordance with the third embodiment of the invention. That is, the upright keyboard instrument of the third embodiment is characterized by arranging a string S instead of the struck portion 60 and by arranging a hammer assembly 140 for striking the string S instead of the hammer assembly 40. The third embodiment is applied to an acoustic upright piano in which approximately twenty keys counted from a rightmost key having a highest pitch are not associated with dampers.

That is, the hammer assembly 140 is constituted by a hammer shank 143*a*, a hammer wood 143*b*, and a hammer felt 143*c*. Specifically, the hammer wood 143*b* is rectangularly attached to one end of the hammer shank 143*a*, and the hammer felt 143*c* is attached to one end of the hammer wood 143*b*. When the key 11 is depressed, the hammer felt 143*c* strikes the string S, which is thus vibrated.

In addition, the aforementioned damper unit 50 is arranged for each of keys belonging to the high-pitch register. Due to the provision of the damper unit 50 used in the second embodiment, it is possible to actualize key-touch feelings when the player depresses keys of the high-pitch register, which may be very close to key-touch feelings realized on keys associated with dampers in an acoustic upright piano.

As described above, the third embodiment actualizes similar key-touch feelings between keys of the high-pitch register not associated with dampers and keys of the other register normally associated with dampers in an acoustic upright piano.

As described heretofore, this invention has a variety of effects and technical features, which will be described below.

(1) This invention aims at actualizing preferable key-touch feelings when depressing keys not associated with dampers, which may be very close or similar to key-touch feelings realized on keys associated with dampers when depressed.

(2) That is, this invention actualizes the player (or user) to experience real key-touch feelings regarding stopped sounds and/or sustained sounds, which can be produced by an acoustic upright piano, even when the player plays an electronic piano. Herein, sound is stopped by releasing a key after depressed under the condition where the player does not depress a loud pedal with the foot, so that sound is intentionally stopped. In this case, the key is depressed under the condition where the damper is apart from the string due to the motion of the key, so that the hammer strikes the string without having a contact with the damper. Then, the key is released under the condition where the damper is brought into contact with the string due to the motion of the key, so that the sound is rapidly damped (or attenuated in tone volume). Therefore, the player can feel a resistance from the key due to the aforementioned control of the damper when depressing and then releasing the key. In addition, a sustained sound is produced by actualizing reverberation when the player depresses and then releases the key while depressing the loud pedal. In this case, the key is depressed and is then released under the condition where the damper is apart from the string, so that resistance due to the provision of the damper is not transmitted to the player's finger depressing the key. Therefore, this invention can actualize the player to feel real key-touch feelings simulating differences between keys associated with dampers and keys not associated with dampers. Furthermore, it is possible to actualize an acoustic upright piano and the like in which substantially uniform key-touch feelings are realized on all keys whether or not they are associated with dampers.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. An upright keyboard instrument comprising:

a plurality of keys;

a plurality of actions interlocked with the plurality of keys respectively;

a plurality of hammer assemblies respectively driven by the plurality of actions in connection with the plurality of keys;

at least one plate spring, which is arranged in proximity to a whippen included in the action, wherein the whippen is forced to rotate upon depression of the key and is normally regulated in rotation by the plate spring, which is brought into contact with the whippen upon depression of the key, wherein elasticity of the plate spring causes resistive force to push up a portion of the whippen in order to simulate a key depression feeling associated with a damper in acoustic upright pianos even in absence of a damper; and a loud pedal unit including a loud pedal interlocked with the plate spring, so that when the loud pedal is depressed, the plate spring is moved to depart from the whippen so as not to regulate rotation of the whippen, thereby actualizing a key-touch feeling that simulates a key touch feeling realized when depressing a key while depressing a loud pedal in acoustic upright pianos.

2. An upright keyboard instrument according to claim 1 further comprising an electronic sound source that produces a musical tone signal when the hammer assembly is driven upon depression of the key.

3. An upright keyboard instrument according to claim 1, wherein the plate spring is moved downwards to escape from the whippen when the loud pedal is depressed.

4. An upright keyboard instrument according to claim 1, wherein the plate spring is moved to escape from a damper spoon planted at a prescribed position of the whippen.

5. An upright keyboard instrument comprising:

a plurality of keys;

a pedal;

an electronic sound source for generating a musical tone signal upon depression of the key;

a damper unit for controlling a damping effect to be imparted to the musical tone signal in response to an operation of the pedal;

a plurality of actions interlocked with the plurality of keys, thus driving a plurality of hammer assemblies to activate the electronic sound source;

a resistance adapter for adapting a resistance to the action, which is driven upon depression of the key in order to simulate a key depression feeling associated with a damper in acoustic upright pianos even in absence of a damper while the pedal is not depressed and in order to actualize a key touch feeling realized when depressing a key while depressing a loud pedal in acoustic upright pianos when the pedal is depressed; and a switching mechanism for switching over whether to adapt the resistance to the action upon operation of the pedal.

6. An upright keyboard instrument according to claim 5, wherein the resistance adapter adapts the resistance to the action at a prescribed timing during depression of the key.

7. An upright keyboard instrument according to claim 5, wherein the action contains a whippen that is forced to rotate upon depression of the key, the resistance adapter contains an elastic member for receiving an end portion of the whippen that is moved downwards upon depression of the key, and the switching mechanism controls the elastic member to approach or depart from the end portion of the whippen upon depression of the pedal.

8. An upright keyboard instrument according to claim 5, wherein the action contains a whippen that is forced to rotate upon depression of the key, the resistance adapter contains a contact member planted vertically on the end portion of the whippen and a plate spring that is arranged opposite to the contact member and comes in contact with the contact member when the whippen is rotated, and the switching mechanism controls the plate spring to approach or depart from the contact member upon operation of the pedal.

9. An upright piano according to claim 8, wherein the resistance adapter includes at least one plate spring, which is normally arranged close to a whippen included in the action and comes in contact with the whippen when rotatably moved with the action upon depression of the key, and wherein the switching mechanism controls the plate spring to depart from the whippen upon depression of the pedal.

10. An upright piano comprising:

a plurality of keys, including a prescribed number of keys not associated with dampers;

a plurality of actions interlocked with the plurality of keys;

a plurality of hammer assemblies, which are respectively driven when the plurality of keys are depressed by way of the plurality of actions;

a resistance adapter for adapting a resistance to each of the actions interlocked with the prescribed number of keys not associated with dampers in order to simulate a key depression feeling associated with a damper in acoustic upright pianos even in absence of a damper while a pedal is not depressed and in order to actualize a key touch feeling realized when depressing a key while depressing a loud pedal in acoustic upright pianos when the pedal is depressed; and a switching mechanism for switching over whether to adapt the resistance to the key included in the prescribed number of keys not associated with dampers upon operation of the pedal.

* * * * *